US005338498A

United States Patent [19]

Lefebvre

[11] Patent Number: 5,338,498

[45] Date of Patent: Aug. 16, 1994

[54] METHOD FOR FORMWORK, AND DISMANTLING OF FORMWORK, OF WALLS OF POURED MATERIAL RAISED ABOVE A REFERENCE SURFACE, AND MEANS FOR EMPLOYMENT OF THIS METHOD

[76] Inventor: Louis Lefebvre, Résidence Orsay C3 630 Avenue de la République, 59800 Lille, France

[21] Appl. No.: 901,136

[22] Filed: Jun. 19, 1992

[30] Foreign Application Priority Data

Jun. 20, 1991 [FR] France ..... 91 07903

[51] Int. Cl.[5] ..... B28B 7/08; E04B 1/16; E04G 11/00

[52] U.S. Cl. ..... 264/31; 249/19; 249/27; 249/137; 249/146; 249/152; 249/153; 249/161; 264/219; 264/333

[58] Field of Search ..... 264/31-35, 264/333, 219; 249/27, 137, 146, 152, 19, 153, 161

[56] References Cited

U.S. PATENT DOCUMENTS

| | | | |
|---|---|---|---|
| 3,815,861 | 6/1974 | Maier | 249/27 X |
| 3,822,853 | 7/1974 | Shelley | 249/27 |
| 3,847,521 | 11/1974 | Stickler, Jr. | 249/27 X |
| 3,990,673 | 11/1976 | Jones et al. | 249/146 |
| 4,017,052 | 4/1977 | Azzaroni | 249/27 X |
| 4,088,296 | 5/1978 | Armas | 249/152 X |
| 4,178,343 | 12/1979 | Rojo, Jr. | 249/27 X |
| 4,679,762 | 7/1987 | Lee | 249/152 X |

FOREIGN PATENT DOCUMENTS

| | | | |
|---|---|---|---|
| 674658 | 11/1963 | Canada | 264/31 |
| 1434431 | 6/1969 | Fed. Rep. of Germany . | |
| 2217444 | 10/1973 | Fed. Rep. of Germany | 249/27 |
| 76407 | 9/1961 | France . | |
| 1512440 | 2/1968 | France . | |
| 1536380 | 7/1968 | France . | |
| 2102571 | 4/1972 | France . | |
| 2388106 | 11/1978 | France . | |
| 473967 | 7/1969 | Switzerland . | |
| 519076 | 3/1972 | Switzerland . | |
| 1150079 | 4/1985 | U.S.S.R. | 249/27 |
| 1190445 | 5/1970 | United Kingdom . | |

*Primary Examiner*—Karen Aftergut

*Attorney, Agent, or Firm*—Kerkam, Stowell, Kondracki & Clarke

[57] ABSTRACT

A method for assembly and disassembly of formwork for walls (1) of poured material raised above a reference surface (2) using boards (3) each including a shuttering face (4) and equipped with wheels (31, 32) at their base. Assembly includes from an unshuttered position, rocking toward the wall (1) to be shuttered of at least the base (29) of the shuttering face (4) of the board (3) by rotating about an axis defined substantially by the support points (10) of the wheels (31) on the reference surface until the lower edge (35) of the shuttering face (4) is made to rest on the reference surface (2). The rocking is continued toward the wall (1) to be shuttered of at least the base (29) of the shuttering face of the board (3) by rotating about an axis substantially defined by the lower edge (35) of the shuttering face of the board (3) until the wheels (31) are raised from the reference surface. For disassembly, the rocking about the two axes is performed in reverse.

7 Claims, 4 Drawing Sheets

METHOD FOR FORMWORK, AND DISMANTLING OF FORMWORK, OF WALLS OF POURED MATERIAL RAISED ABOVE A REFERENCE SURFACE, AND MEANS FOR EMPLOYMENT OF THIS METHOD

FIELD OF THE INVENTION

The invention relates to a method for formwork, and dismantling of formwork, for walls of poured material raised above a reference surface, and means for employment of this method.

More particularly it applies to making free-standing or load-bearing walls and internal partitions of buildings.

BACKGROUND OF THE INVENTION

At present, for formwork and dismantling formwork of building free-standing or load-bearing walls, boards (French Patent Disclosure A 1.277,437) are generally used, each including a shuttering face formed by one of the faces of a plate which is provided on its opposite face with reinforcements disposed along directions perpendicular to one another, in order by its rigidity to guarantee the geometric correction of the shuttered wall.

The shuttering face generally has a height substantially equal to the height of the wall to be poured, and a width as great as possible while remaining sufficiently slight to limit the weight of the board and as a result, for each face of the wall to be shuttered, use is generally made of a plurality of boards disposed longwise of one another and assembled together by means that assure continuity of the shuttering face.

Accordingly, these boards have their shuttering faces placed vertically facing one another, and they are braced against one another with a spacing between them corresponding to the thickness of the wall.

On at least one of their ends, they are provided with closure panels that shutter the vertical edges of the walls, or at least assure that the poured material will not escape at the sides.

To guarantee the verticality of their shuttering faces, these boards are associated, by their stiffeners, with a structure that affords the board at least one point of possibly adjustable support on the reference surface, at a certain distance from the shuttering face.

In the case where the free-standing or load-bearing walls are poured separately from horizontal walls joining the upper edges of two successive walls, the structure is generally formed by triangular trusses provided at a suitable distance with a support on the reference surface (French Patent Disclosure A 1,277,437).

In the most general case, where contrarily it is desirable, simultaneously with the vertical walls, to pour the horizontal wall that extends between the upper edges of those successive vertical walls, such as the ceiling slab of two free-standing or load-bearing walls of the same cubicle as a part of a building, the boards are disposed vertically with their stiffened faces facing one another, with a spacing between them corresponding to the distance between the vertical walls of the same cubicle and joined to one another:

first, in their upper part, by flooring in one or more parts, having a shuttering face, formed by the upper face of a plate whose lower face cooperates with stiffeners disposed in two directions perpendicular to one another, to guarantee the geometric correction of the wall, and second, by adjustable crossbeams near their base.

In this case, each board thus associated with the other board directly makes the structure that affords the other board the support point guaranteeing its verticality.

The associated vertical and horizontal shuttering faces lend the entire formwork apparatus the shape of an inverted U, commonly called a tunnel.

As for the flooring or at least one of its parts, it is known to associate it with a support structure on the reference surface that lends it the form of a table (French Patent Disclosure A 1,345,570).

It is also known to make the shuttering part of the board inseparable from the shuttering face of at least one part of the flooring.

In one known embodiment (French Patent Disclosure A 1.180,699), the flooring, properly stiffened by itself in two perpendicular directions, is cut into at least two lengths that are rejoined along the planes of joints parallel to the boards, and each length of flooring adjoins a board by its shuttering face associated with that of the board and by its transverse stiffeners articulated to the vertical stiffeners of the boards, so that the parts, generally called half-shells, of the tunnel-like formwork apparatus can be dismantled by deforming the dihedral angle between the length of flooring and the board.

In another known embodiment (French Patent Disclosure A 1.512.440), the flooring is not stiffened, at least locally, by itself except in a direction parallel to the boards, and at the time the formwork is done, in order to have the requisite evenness, it rests freely on crossbeams associated with the stiffeners of the boards.

To permit dismantling of the formwork, these support crossbeams of the flooring are each constituted by at least two profile sections articulated on the one hand to one another under the middle part of the flooring and on the other, by one of their ends, to the stiffeners of one of the boards.

The profile sections of these crossbeams, commonly known as scissors, can be maneuvered so as to form an angle between them that turns its concave side toward the flooring, thus at least locally depriving the flooring of its transverse stiffeners, so that by its own weight or by traction it can sag and thus assure dismantling of the horizontal wall, but also of the top of the vertical walls, by inclination of a few degrees, because of the reduction in the spacing that the maneuvering of the scissors induces in the upper portion of the tunnel.

In these two tunnel-type embodiments, and it is understood for pouring horizontal walls, such as closure panels provided on the boards, the flooring elements are equipped on their edges with slab-type stop panels, whose height is at least equal to the thickness of these horizontal walls, to prevent the poured material from escaping at the sides.

Regardless of the type of board used to finish off the dismantling of the formwork, its base is also, in a second period of time, disengaged from the wall by action on the structure provided on the back of the boards.

Although by itself the reference surface allows correct positioning of the boards both in height and in verticality, it does not allow determining the position of the base of the shuttering face of the board in the plane of this reference surface.

For that purpose, benchmarks provided with vertical faces rising to a low height are provided on the reference surface, each defining the position of the plane of one face of the wall to be erected, and against which the basis of the shuttering faces of the boards can then be made to abut.

To facilitate handling of these boards and the structures with which they are associated, the boards are currently equipped with wheels on their base that each rotate generally freely about an axis perpendicular to the shuttering face and supported by a cover attached directly to the back face of the shuttering plate, at a height such that the lower part of each wheel is located at a lower level than the lower edge of the shuttering face when the shuttering face is at least substantially vertical.

The lower edge of the shuttering face of the board can thus, with play and hence without friction on the reference surface, enable displacement of the board in a direction parallel to itself.

Since being supported by the wheels on the reference surface does not guarantee a definitive position of the board in its plane nor its immobilization, so that correct support is given to the boards in the formwork process, their wheels must be disengaged from the reference surface, and to that end, jacks are provided on the base of the boards, with a vertical axis and the lower end of which is provided with a runner for support on the reference surface.

Thus in the embodiments known at the present time, for pouring, the lower edge of the shuttering faces of the boards is always raised by the initial play increased by the height of disengagements of the wheels from the reference surface.

The corresponding interstice necessitates the provision, on the reference surface and/or on the boards, of means with a view to preventing the poured material from being capable of escaping.

To that end, it is known to provide a removable panel on the base of the boards for closure of the aforementioned interstice, but this panel, commonly known as an underlay block, and its means for articulation to the board make the board more complicated and require that additional maneuvering be done on the building site, which has a deleterious effect on the cost.

Another known solution consists in making positioning stops on the reference surface, which extend over the entire length of the boards and thus form footings of free-standing or load-bearing walls.

To make these footings at the same time as the walls and the ceiling slab on the lower level, it is necessary to provide not only the means associated with the boards on the lower level but also formwork angles for the footing and means for flanging them in the required position, which also increases the cost of the building site equipment and the cost for construction.

Moreover, the support of the shuttering face of the board on such a footing is never perfect, and hence defects in surface evenness appear on the formwork wall.

SUMMARY OF THE INVENTION

One of the objects the invention seeks to attain is a method for formwork and dismantling thereof that assures perfectly tight sealing at the base of the boards, without requiring the provision of underlay blocks or footings for free-standing or load-bearing walls.

Another object the invention seeks to attain is a board that is simple and easy to use.

To this end, its subject is a method of the type described above characterized in particular in that:

for the formwork:

from the unshuttered position, by rocking toward the wall to be shuttered of at least the base of the shuttering face of the board, to that end rotating about an axis defined substantially by the support points of the wheels on the reference surface, the lower edge of the shuttering face is made to rest on the reference surface, and then continuing the rocking toward the wall to be shuttered of at least the base of the shuttering face of the board but to that end rotating about an axis substantially defined by the lower edge of the shuttering face of the board, the wheels are raised from the reference surface, and conversely, for dismantling the formwork:

from the shuttered position, by rocking of at least the base of the shuttering face of the board in the direction of its spacing apart from the shuttered wall, by rotating about the axis substantially defined by the lower edge of the shuttering face, the wheels are made to rest on the reference surface, and continuing the rocking in the same direction but rotating now about the axis substantially defined by the support points on the reference surface, the lower edge of the shuttering face is raised from the reference surface.

The invention will be better understood from the ensuing detailed description, which is understood to be a non-limiting example, in conjunction with the accompanying drawings.

BRIEF DESCRIPTION OF THE DRAWINGS

(FIG. 1) a shuttered wall position;

(FIG. 2) a partially shuttered or unshuttered wall position depending on the direction of maneuvering;

(FIG. 3) an unshuttered wall position, with a board that can be displaced on its wheels;

DESCRIPTION OF THE PREFERRED EMBODIMENT

Figure 3:
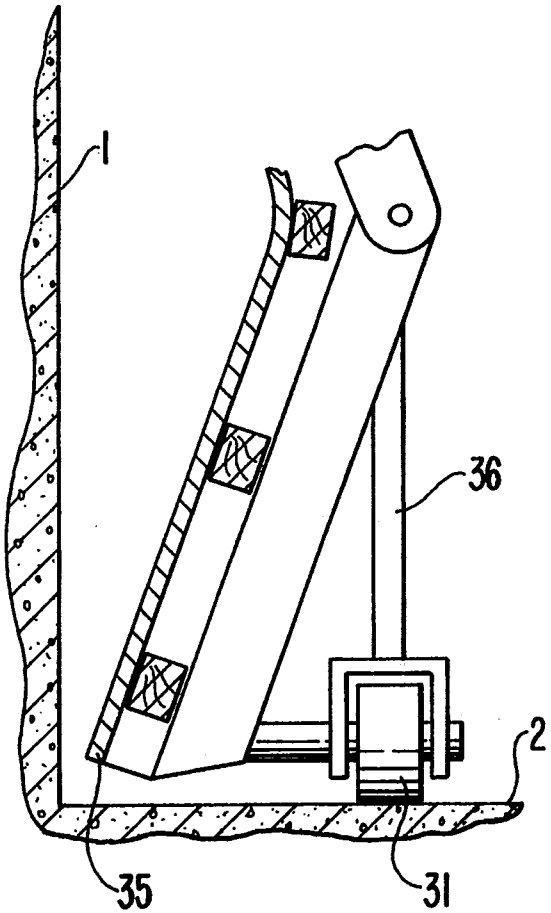
FIGS. 1–3 are a block diagram of the method showing the base of the board in three different positions, that is.

The shuttering face 4 has a height substantially equal to the height of the wall.

For formwork for a free-standing or load-bearing wall, these boards 3 are placed vertically with their shuttering faces 4 facing one another and joined to one another by spacer races (not shown) that between them maintain a spacing equal to the thickness of the wall.

To guarantee the verticality of the boards 3, the boards are associated by their stiffeners 7, 8 with a structure 9 offering at least one, optionally adjustable, point of support 10, 11 on the reference surface 2, at a certain distance behind said board.

In the case where the vertical walls 1 are poured separately from horizontal walls 12 joining the upper edges 13 of two successive walls, the structure (not shown) may be formed by triangular trusses provided with a suitable distance from a support on the reference surface.

In the more general case where contrarily, simultaneously with the vertical walls 1, one wishes to pour the horizontal wall 12 extending between the upper edges 13 of these successive vertical walls 1, such as a ceiling slab 12, the boards 3 are disposed vertically, with their strengthened faces 5 facing one another, with a spacing between them corresponding to the distance between the vertical walls 1 of the same cubicle and connected to one another:

on the one hand, in their upper portion 14, by flooring 15 in one or more parts, having a shuttering surface 16 formed by the upper face of a plate 17, whose lower face 18 cooperates with strengtheners 19, 20 disposed in two perpendicular directions, so as to guarantee the geometrical correction of the horizontal wall at the time of the formwork, and second, by adjustable crossbeams 22 near their base 21.

In that case, the boards 3 thus associated each directly make the structure 9 that offers the other board the support point that guarantees its verticality.

The shuttering faces 4, 16 thus combined lend the overall formwork apparatus the shape of an inverted U, known as a tunnel.

The flooring 15, or at least one of its parts, may be associated with a structure (not shown) for support on the reference surface.

Generally, the shuttering face 16 of the flooring is made inseparable from the face 4 of at least one of the boards.

For example (FIG. 6), the flooring 16 is cut into at least two lengths that are joined together along joint planes parallel to the boards 3, and each length adjoining one board has its shuttering face 16 thus associated with the shuttering face 4 of the corresponding board, and has its transverse stiffeners 20 articulated to the vertical stiffeners 7 of the boards 3, to enable dismantling the formwork by deformation of the dihedral angle formed by the shuttering faces 4, 16 in question, for example by acting upon a prop 23 associated with the free end of the flooring part 15.

Figure 4:
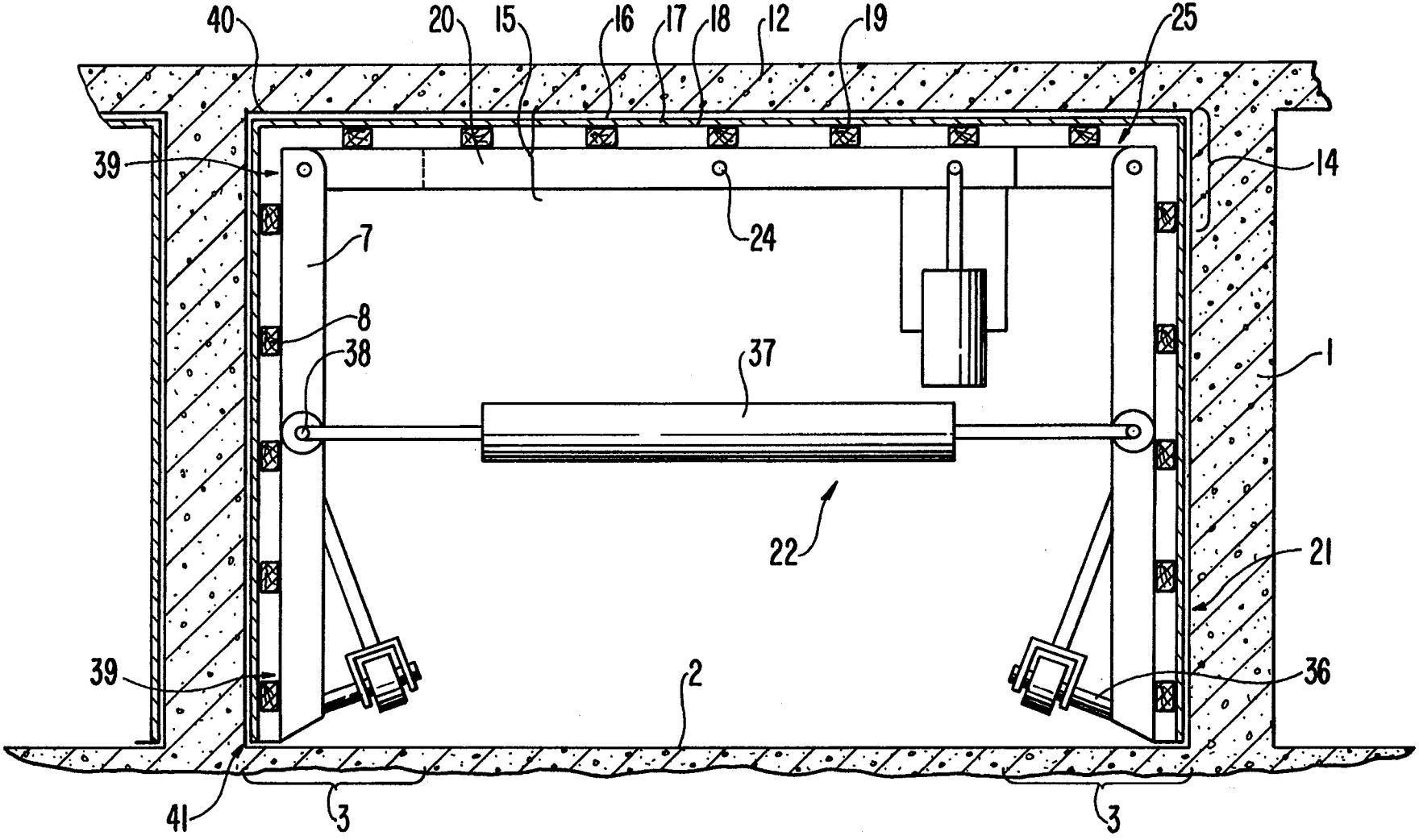
FIG. 4 shows a retractable tunnel-type formwork in the shuttered position.
Figure 5:
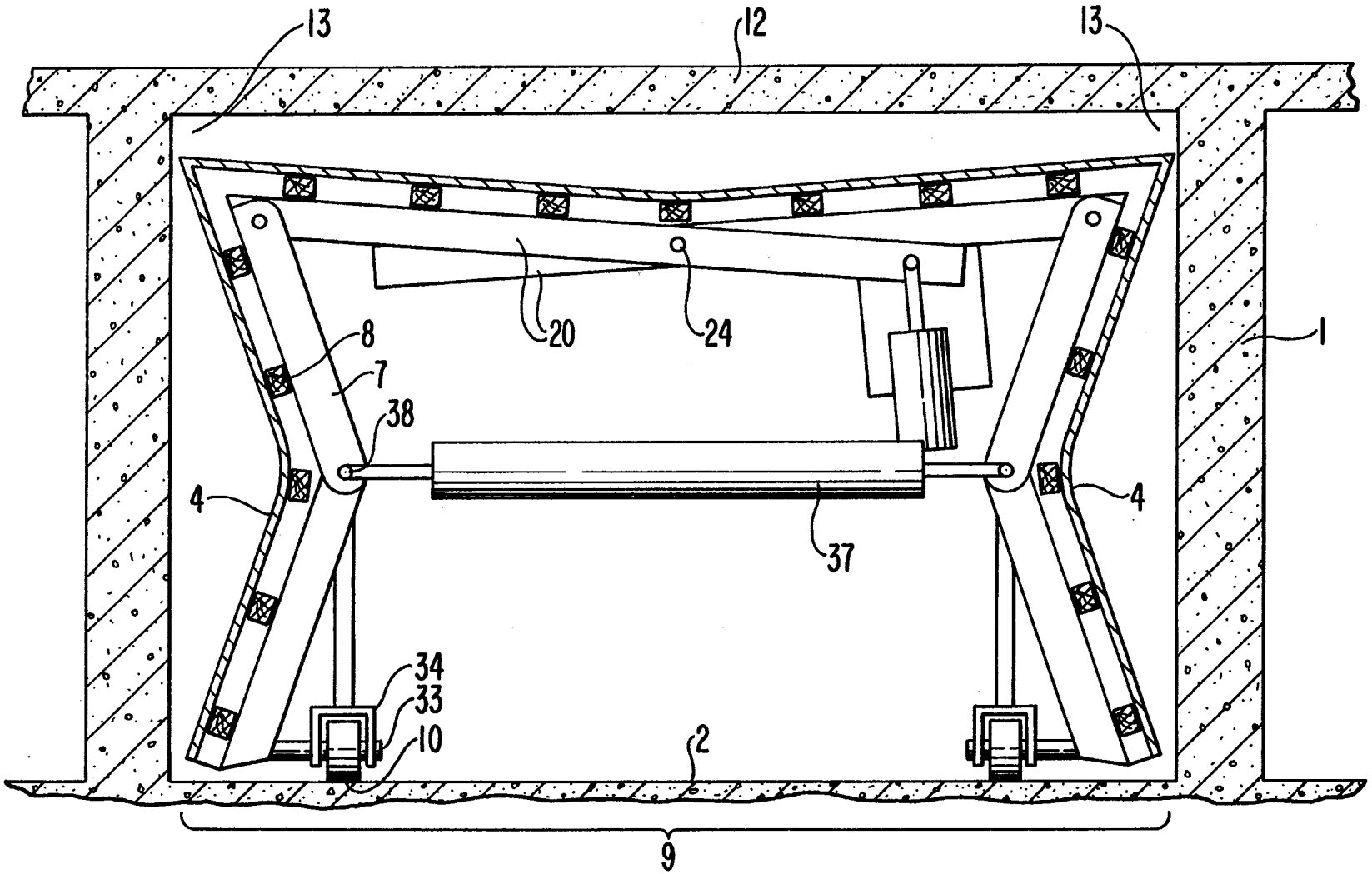
FIG. 5 shows a retractable tunnel-type formwork in the unshuttered position.

In a variant embodiment (FIGS. 4 and 5), the flooring 15 is not stiffened at least locally by itself except in a direction parallel to the boards 3, and at the time of the formwork (FIG. 4), in order to have the requisite flatness, it rests freely on crossbeams 20 associated with the stiffeners of the boards.

To enable the dismantling of the formwork, these crossbeams supporting the flooring are each constituted by at least two profile sections 20 articulated about an axis 24 parallel to the boards:

first, between them, under the median portion of the flooring, and second, at one of their ends 25, to the stiffeners 7 of one of the boards 3.

The profile sections of these crossbeams 20, commonly called scissors, may be maneuvered in such a way as to form an angle between them that turns its concavity toward the flooring 15, thus depriving the flooring of its transverse stiffeners so that by its own weight or by traction it can curve inward (FIG. 5), and to assure the dismantling of the formwork for the horizontal wall 12 but also of the top of the vertical walls 1 by inclination by several degrees, because the reduction in the spacing that maneuvering the scissors beings about in the upper portion, hence the designation "retractable tunnel" that is conventionally given to it.

Figure 2:
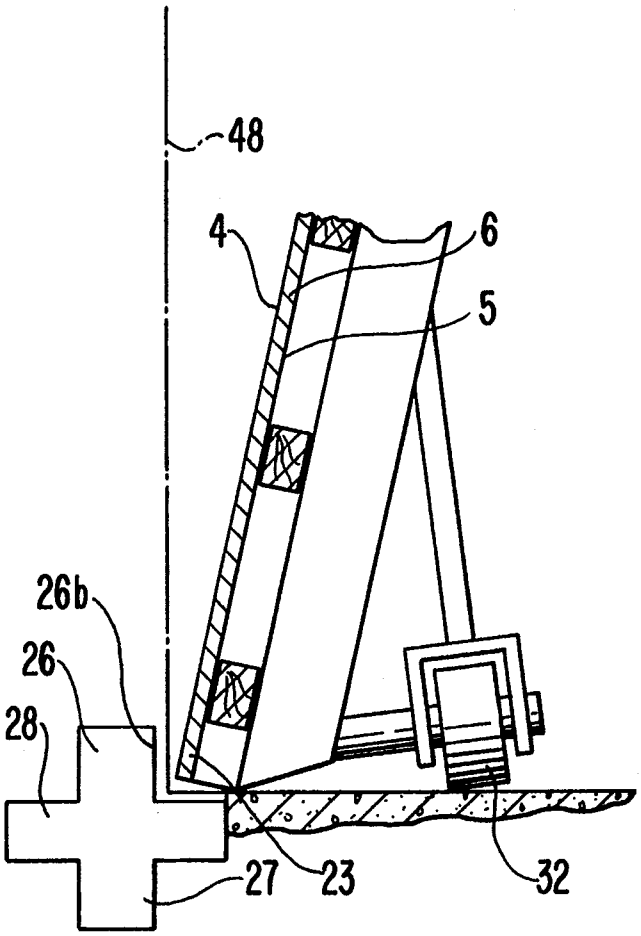

On this reference surface 2 (FIG. 2), benchmarks 26 are provided, which have vertical faces **26*b* rising to a low height, each defining the position of the plane of one face 48 of the vertical wall 1 to be erected and against which the bases 29 of the shuttering faces 4** of the boards can then be made to abut to determine the position of the case of their shuttering face in the plane of said reference surface, but also to afford firmer support than on the freshly poured concrete when the formwork is dismantled.

These benchmarks 26 may, in a known manner, be formed of concrete crosses of any arbitrary thickness, but with a width of the vertical and horizontal arms, 27 and 28, respectively, corresponding to the width of the vertical and horizontal walls to be shuttered.

Between the boards 3 shuttering each vertical wall 1, crosses are then simply engaged by one of their vertical arms until their horizontal arms abut the top of the boards so that above the horizontal arms or above the ceiling slab 12 that is to be poured, the upper vertical arm 27 of the cross forms the necessary benchmark 26 for the wall 1 that will then be shuttered at the higher level.

The remainder of the cross 26 will be embedded in the poured walls.

To facilitate the manipulation of these boards 3 and of the structures 9 which are associated with them, these boards 3 are equipped with wheels 31, 32 at their base, each rotating generally freely about an axis 33 of a cap 34 associated with the board in such a manner that in the position for dismantling the formwork, with the board ready for displacement, it rests on the reference surface 2, while the lower edge 35 of the shuttering face 4 is spaced apart from the surface 2.

The board is furthermore provided with means 36, which at the time of the formwork contrarily keep these wheels above the plane of the reference surface 2.

Figure 1:
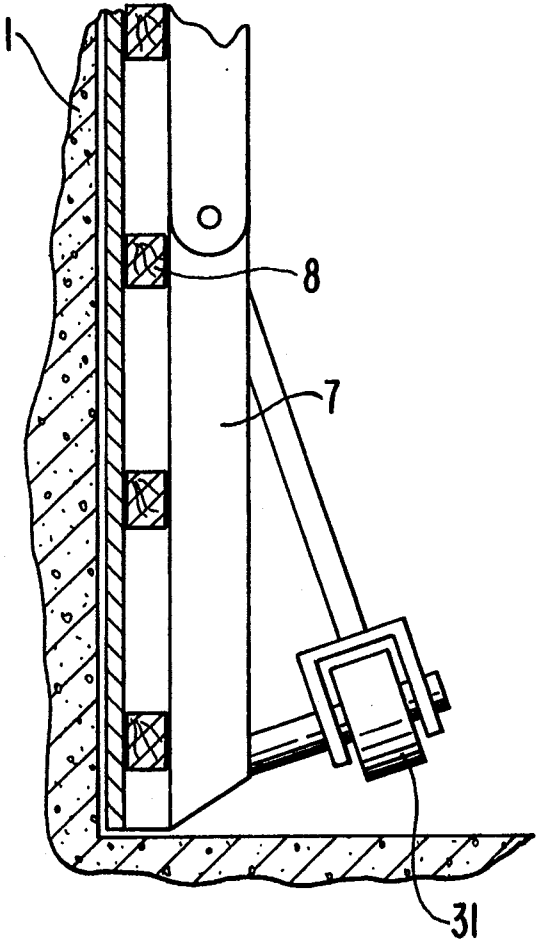

For the formwork, instead of raising the board 3 and its wheels from the reference surface 2 by maneuvering support jacks on the reference surface for that purpose and employing means for closure of the interstice thus created on the lower edge of the shuttering face, either beforehand or afterward depending on the nature of these closure means, according to an essential characteristic of the method that is the subject of the invention:

for the formwork:

from the unshuttered position (FIG. 3), by rocking at least the base 29 of the shuttering face 4 of the board 3 toward the wall 1 to be shuttered, rotating it to that end about an axis defined substantially by the support points 10 of the wheels 31 on the reference surface, the lower edge 35 of the shuttering face 4 is made to rest on the reference surface 2 (FIG. 2), and then continuing rocking at least the base 29 of the shuttering face of the board 3 toward the wall 1 to be shuttered but to that end rotating it about an axis substantially defined by the lower edge 35 of the shuttering face of the board 3, the wheels 31 are raised from the reference surface (FIG. 1), and conversely, for dismantling the formwork:

from the shuttered position (FIG. 1), by rocking of at least the base 29 of the shuttering face 4 of the board 3 in the direction of its spacing apart from the shuttered wall 1, by rotating about the axis substantially defined by the lower edge 35 of the shuttering face 4, the wheels 31 are made to rest on the reference surface 2 (FIG. 2), and continuing the rocking in the same direction but rotating now about the axis substantially defined by the support points 10 on the reference surface 2, the lower edge 35 of the shuttering face 4 is raised from the reference surface 2.

In a first operating mode that is more precisely but not exclusively applicable when the horizontal walls are poured independently of the vertical walls, rocking actions are done while preserving the flatness of the shuttering face of the board.

In a preferred mode of operation (FIGS. 4–6), the rocking actions are done in one direction and in the other, respectively, by cradling and uncradling the shuttering face to lend it, in profile, a concavity oriented toward the wall during the dismantling, and contrarily during the formwork to cancel this concavity and have the requisite flatness.

One of the essential advantages of the method is indeed that of avoiding recourse to footings of free-standing or load-bearing walls or to underlay blocks, since there is no longer any interstice to be plugged under the lower edges of the shuttering faces.

Another major advantage of the method, according to which the rocking is done by cradling/uncradling, is an ease of manipulation of the slab in the cubicle because of the resultant reduction in height for the board.

In the case where the boards are used independently of any shuttering flooring, they can nevertheless advantageously be used as a support for the prefabricated slab, thus allowing the simultaneous pouring of the ceiling and of free-standing or load-bearing walls, regardless of the absence of flooring.

The means for employing this method include in combination:

rollers 31 for support, at the time of formwork dismantling, on the reference surface 2, which are associated with the shuttering face 4 at a distance and height such that in the shuttered position, these rollers will be located entirely above the level of the lower edge 35 of the shuttering face 4, means 37 for controlling the rocking actions of at least the base of the shuttering face of the board.

In a preferred embodiment, the rocking control means include means for alternatingly controlling the cradling, at the time of the formwork dismantling, and cradling, at the time of the formwork, of the plate 6 of the shuttering face in a direction lending the shuttering face, as seen in profile, at the time of the formwork dismantling, a concavity turned toward the wall 1.

To this end, the horizontal longitudinal stiffeners 8 of the plate of the board 3 having the shuttering face 4 are solidly joined to the back face 5 of this plate 6 having the shuttering face 4, in such a manner as to constantly assure its longitudinal rigidity, the vertical stiffeners 7 in turn being independent, at least in their median portion, of the plate 6 and of its horizontal stiffeners 8 and constituted by cross beams, which in the shuttered position simply assume support against the horizontal stiffeners 8, these crossbeams 7 being constituted by at least two profile sections, on the one hand articulated to one another in the manner of scissors about a horizontal axis 38 behind the shuttering plate 6, substantially halfway up that plate, and on the other, connected at one of their ends 39 at least indirectly to the upper 40 and lower 41 edges of the board 3 respectively.

Figure 6:
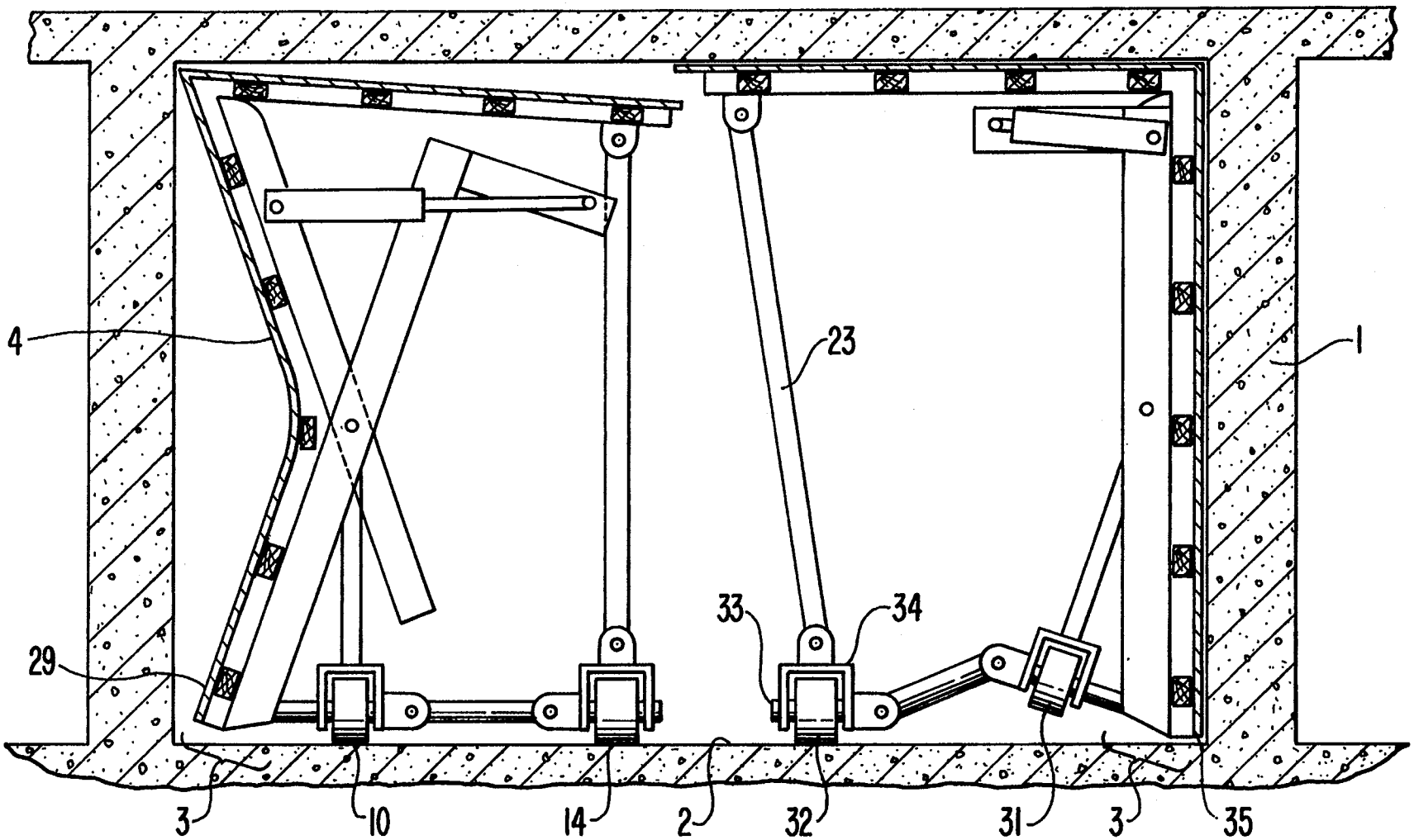
FIG. 6 shows a half-shell tunnel-type formwork with the half-shell on the right in the drawing shown in the shuttered position and the other being shown in the unshuttered position.

Preferably, although not shown except in FIG. 6, in the various embodiments, beyond their common axis, the profile sections constituting the scissor arms are extended on the side opposite their end associated with the board, so that this extension cooperates with the stiffening of the plate.

To the same end, the brace (not shown) joining the shuttering boards on the two sides of the same free-standing or load-bearing wall will then preferably be supported on a flange solid with this extension of one of the blades of the scissors, which flange, in the shuttered position, will in turn be supported on the other blade of the scissors.

The board also includes a means 37 for maneuvering the scissors, such as a screw jack or hydraulic jack.

Since the weight of the plate does not assist the plate in its cradling, advantageously, the board may include linkage means between the panel, or at least one of its horizontal stiffeners, and the scissors.

To control the simultaneous cradling of the boards of the same tunnel, the scissors of opposed boards are joined by an adjustable-length crossbeam 37, such as a screw jack or hydraulic jack which during the pouring also assures the restoration of the hydrostatic pressure of the concrete.

The support on the reference surface 2 of the lower edge 35 of the shuttering face 4 may advantageously be effected by way of a sealing gasket, so as to absorb any irregularities due to roughness of the reference surface.

The fact that the boards 3 are designed as claimed above will be understood not to present any hindrance to the simultaneous formwork, in at least one cubicle, they include a third vertical wall, perpendicular to the preceding two, a bottom panel (not shown) whose peripheral sealing tightness at the time of the formwork is assured by an inflatable cushion, and which at the time of dismantling of the formwork may be placed in an inclined position along the diagonal of the cubicle and leaving the cubicle on a carriage, for example.

It will be understood that any accessory means known at present, such as closure panels and slab stops, may be combined with the aforementioned means.

I claim:

1. A method for assembling formwork and disassembling formwork for forming vertical walls of poured material raised above a reference surface, the formwork having boards (3), each including a plate (6) having two faces (4, 5), one of the faces being a shuttering face (4) having a height substantially equal to a height of a vertical wall being formed and the formwork having stiffeners (7, 8) disposed in two perpendicular directions and attached to another of the two faces of the plate (6) to maintain the plate (6) against the vertical wall (1) which is being formed, the reference surface (2) having benchmarks (26) with vertical faces (**26*b*) rising to a height lower than the height intended for the vertical wall (1); each vertical face defining an intended location of a plane of a face (48) of the vertical wall (1) and against which bases (29) of the shuttering faces (4) are positionable to maintain the shuttering faces (4) in the planes of the faces (48) of the vertical wall (1), each of the boards (3) being attached by the stiffeners (7, 8) to a structure having at least one point of support (10, 11) on the reference surface (2**) offset from the board by a given distance behind the board, each of the boards (3) being equipped with wheels (31, 32) at their base, each wheel rotating freely about an axis (33) of a cap (34) associated with the board, the formwork further having means (36) maintaining the wheels (31) above a plane of the reference surface (3) when the vertical wall (1) is being formed;

the method comprising the steps of:

(a) assembling the formwork by:

(a1) starting from an unshuttered positioned in which each of the wheels (31, 32) rests on the reference surface while the shuttering faces are raised from the reference surface, rocking the base (29) of each of the shuttering faces (4) toward the intended location of the vertical wall (1) by rotating about an axis defined by the support points (10) of the wheels (31) on the reference surface (2) until a lower edge (35) of each of the shuttering faces (4) is made to rest on the reference surface (2), (a2) continuing the rocking of the base (29) of each of the shuttering faces (4) by rotating about an axis defined by the lower edge (35) of each of the shuttering faces as the wheels (31) are raised from the reference surface thus placing the formwork in the shuttered position; and (b) disassembling the formwork following the pouring of material next to the boards to form the vertical wall (1) by:

(b1) from the shuttered position with the lower edge (35) of each of the shuttering faces (4) on the reference surface, rocking the base (29) of each of the shuttering faces (4) away from the formed vertical wall (1) by rotating about the axis defined by the lower edge (35) of each of the shuttering faces (4) until the wheels (31) rest on the reference surface (2), and (b2) continuing the rocking of the base in the same direction by now rotating about the axis defined by the support points (10) of the wheels (31) resting on the reference surface (2) until the lower edge (35) of each of the shuttering faces (4) is raised from the reference surface (2) thus placing the formwork in the unshuttered position.

2. The method of claim 1, characterized in that the rocking steps are done while preserving flatness of the shuttering face of each of the boards.

3. The method of claim 1, characterized in that the rocking steps are done in one direction and in the other, respectively, by cradling and uncradling the shuttering faces to lend them, in profile, a concavity oriented toward the vertical wall during the disassembly and contrarily during the assembly to cancel this concavity and have a requisite flatness.

4. An apparatus for forming vertical walls of poured material raised above a reference surface by assembling formwork and disassembling formwork for the vertical walls comprising:

formwork having boards (3), each including a plate (6) having two faces (4, 5), one of the faces being a shuttering face (4) having a height substantially equal to a height of the vertical wall being formed and the formwork having stiffeners (7, 8) disposed in two perpendicular directions and attached to another one of the two faces of the plate (6) to maintain the plate (6) against the another one of the two faces of vertical wall (1) which is being formed, the reference surface (2) having benchmarks (26) with vertical faces (26*b*) rising to a height lower than the height intended for the vertical wall (1); each vertical face defining an intended location of a plane of a face (48) of the vertical wall (1) and against which bases (29) of the shuttering faces (4) are positionable to maintain the shuttering faces (4) in the planes of the faces (48) of the vertical wall (1) during formation thereof, each of the boards (3) being attached by the stiffeners (7, 8) to a structure having at least one point of support (10, 11) on the reference surface (2) offset from the board by a given distance behind the board, each of the boards (3) being equipped with wheels (31, 32) at their base, each wheel rotating freely about an axis (33) of a cap (34) associated with the board, the formwork further having means (36) maintaining the wheels (31) above a plane of the reference surface (3) while the vertical wall (1) is being formed; and wherein the wheels are mounted such that, in the shuttered position during the forming of the vertical wall, the wheels are entirely above a level of a lower edge (35) of each of the shuttering faces (4) which lower edges (35) are made to rest on the reference surface by rocking action of the bases, and in the unshuttered position when the shuttering faces are displaced from the reference surface, the wheels are resting on the reference surface, and the apparatus further including means (37) for controlling rocking action of the bases of the shuttering faces such that the bases of the shuttering faces are rocked either toward or away from the intended location of the vertical wall by rotation about an axis defined by the support points of the wheels resting on the reference surface and that rocking of the bases of the shuttering faces by rotation about an axis defined by the lower edge of each of the shuttering faces resting on the reference surface causes the wheels to be either raised above the reference surface or lowered to rest on the reference surface, respectively.

5. The apparatus of claim 4 wherein the means for controlling rocking action includes means for causing the rocking in one direction and in the other, respectively, by cradling and uncradling the shuttering faces to lend them, in profile, a concavity oriented toward the vertical wall during the disassembly and contrarily during the assembly to cancel this concavity and have a requisite flatness.

6. The apparatus of claim 5, characterized in that only horizontal longitudinal stiffeners (8) of the plate of each of the boards (3) having the shuttering face (4) are solidly joined to a back face (5) of the plate (6), in such a manner as to constantly assure longitudinal rigidity of the plate, while vertical stiffeners (7) in turn are independent, at least in their median portion, of the plate (6) and of the horizontal stiffeners (8) of the plate and are constituted by cross beams, which in the shuttered position simply assume support against the horizontal stiffeners (8), the cross beams (7) being constituted by at least two profile sections, articulated to one another for pivoting about a horizontal axis (38) behind the plate (6), substantially halfway up the plate, and connected at one of their ends (39) at least indirectly to upper (40) and lower (41) edges of the boards (3), respectively.

7. The means of claim 6, characterized in that each of the boards locally includes linkage means between the plate, or at least one of the horizontal stiffeners, and the cross beams.

* * * * *

UNITED STATES PATENT AND TRADEMARK OFFICE

CERTIFICATE OF CORRECTION

PATENT NO. : 5,338,498

DATED : August 16, 1994

INVENTOR(S) : Louis Lefebvre

It is certified that error appears in the above-identified patent and that said Letters Patent is hereby corrected as shown below:

In column 4, following the heading "DESCRIPTION OF THE PREFERRED EMBODIMENT" prior to line 54, insert the following:

-- Turning to the drawing, it can be seen that two boards 3 are used for assembly and disassembly of formwork for a vertical wall 1, like a free-standing or load-bearing wall, of poured material, such as optionally reinforced concrete, above a reference surface 2. The surface 2 may be the upper face of a floor slab or of a cap. Each board 3 includes a shuttering face 4 formed by one of the faces 4, 5 of a plate 6. When the formwork is used, stiffeners 7, 8 are disposed in two directions perpendicular to one another to guarantee the geometric correct positioning (required flatness) of the shuttered wall 1. --

In column 9, line 13 [claim 1, line 36]: delete "positioned" and substitute therefor -- position --

In column 10, lines 3-4 [claim 4, lines 12-13]: delete "another one of the two faces of"

Signed and Sealed this

Twenty-seventh Day of December, 1994

*Attest:*

Bruce Lehman

BRUCE LEHMAN

*Attesting Officer*

*Commissioner of Patents and Trademarks*